US005165428A

United States Patent [19]

Stohr

[11] Patent Number: 5,165,428

[45] Date of Patent: Nov. 24, 1992

[54] DEFORMABLE FOAM CURLER

[75] Inventor: Arno Stohr, Grenzacherstr. 17, 8640 Kronach, Fed. Rep. of Germany

[73] Assignee: Anne Stöhr, Kronach, Fed. Rep. of Germany

[21] Appl. No.: 733,963

[22] Filed: Jul. 22, 1991

Related U.S. Application Data

[63] Continuation of Ser. No. 934,893, Nov. 25, 1981, abandoned.

[30] Foreign Application Priority Data

Nov. 27, 1985 [DE] Fed. Rep. of Germany ..... 3541842

[51] Int. Cl.[5] ..... A45D 2/18

[52] U.S. Cl. ..... 132/246; 132/250

[58] Field of Search ..... 132/222, 223, 226, 246, 132/247, 250, 268

[56] References Cited

U.S. PATENT DOCUMENTS

| | | | |
|---|---|---|---|
| 2,061,817 | 11/1936 | Van Cleef | 132/44 |
| 2,262,478 | 11/1941 | Thompson et al. | 132/55 |
| 2,542,601 | 2/1951 | Van Cleef | 132/43 R |
| 2,693,809 | 11/1954 | Spencer | 132/246 |
| 2,838,054 | 6/1958 | Fischer | 132/246 |
| 2,867,222 | 1/1959 | Otto et al. | 132/226 |
| 4,540,006 | 9/1985 | Collis | 132/39 |
| 4,577,647 | 3/1986 | Fenster et al. | 132/39 |
| 4,648,414 | 3/1987 | Fox et al. | 132/246 |
| 4,823,458 | 4/1989 | Hollenberg et al. | 29/527.2 |
| 4,834,118 | 5/1989 | Goeller | 132/246 |

FOREIGN PATENT DOCUMENTS

| | | | |
|---|---|---|---|
| 3346164 | 7/1984 | Fed. Rep. of Germany | 132/226 |
| 3089109 | 4/1988 | Japan | 132/246 |

*Primary Examiner*—Gene Mancene
*Assistant Examiner*—Frank A. LaViola
*Attorney, Agent, or Firm*—Finnegan, Henderson, Farabow, Garrett & Dunner

[57] ABSTRACT

The method for making a deformable hair curler includes forming a cylindrical plastic body section by cross-cutting a peripherally sealed extrusion formed sealing cord, inserting a formative pliable core into the plastic body section, sealing any openings formed in the plastic body section during the insertion of the pliable core, and structuring the outer surface of the plastic body section so that air circulating channels are formed therein. The pliable core may be heated before it is inserted into the plastic body so that the plastic body and pliable core are bonded together. The deformable foam curler is constructed exclusively of a deformable plastic body and a formable pliable core. The pliable core may be made of any material that can easily be bent and retain a bent shape.

10 Claims, 1 Drawing Sheet

DEFORMABLE FOAM CURLER

This application is a continuation, of application Ser. No. 06/934,893, filed Nov. 25, 1986 abandoned.

BACKGROUND OF THE INVENTION

The invention relates generally to deformable foam curlers which have a foam body and a formative pliable core, and more particularly, to a method for making foam curlers in which the formative pliable core is inserted into the foam body.

Conventional deformable foam curlers are made up of a cylindrically shaped plastic foam body and a wire core. Because foam curlers are easy to handle and offer a pleasant feeling to one who is wearing them, foam curlers have a well established place in the field of hair care equipment. Deformable foam curlers are, for example disclosed in West German Patent Document No. DE-OS 34 672. For their manufacture, a plastic body is poured into a respective mold, into which a wire core was previously inserted, whereby the plastic material is welded and sealed together with the material of the wire core. This manufacturing procedure is relatively costly since it requires a closed mold which must be constructed in a way to insure that the wire core remains fixed in a predetermined position during the pouring process.

Another type of soft foam curler and a method for its manufacture is disclosed in West German Patent Document No. DE-OS 33 46 164. A synthetic foam material body is produced in continuous length form together with an inserted wire also of continuous length. The foam rubber is produced by a direct fumigating process with physical fuels. After its production, the continuous foam and wire length is cut into separate curler length pieces and worked on at the cut ends to insure that the wire insert does not protrude from the cut ends. To avoid the danger of injury, the foamed-in wire ends must be shortened or bent, which leads to an increased stress on the plastic material and thereby to a pre-programmed destruction of the foam curler. Furthermore, the finishing work on the foam curler is costly, since material already used must be removed which leads to unnecessary waste.

Another conventional way of producing foam curlers is to punch out cylindrical bodies from plastic material plates of a thickness corresponding to the length of the finished curlers and provide the cylindrical bodies with a wire insert. This production process leads, in most synthetic foam materials used for these products, to an open-pore surface of the plastic body, since during the punching-out process the foam bubbles are destroyed. Furthermore, material waste is incurred during the punching-out process, increasing the costs of material and production.

All of the above described conventional deformable foam curlers have the disadvantage that when used to curl a persons wet hair, the rolled-up hair dries very slowly. Either the plastic body is not absorbent and has a smooth surface, in which instance the hair can, because of reduced air circulation, only dry slowly, since any moisture is removed only on the side away from the curlers, or the foam curlers have an open-pore type surface which soaks up the water, whereby the soaked up water must evaporate before the hair is dried in a satisfactory manner.

SUMMARY OF THE INVENTION

It is, therefore, the object of the present invention to establish a cost-effective method for the manufacture of foam curlers. Furthermore, it is the object of the present invention, to provide a curler of the deformable foam type that can be produced cost-effectively.

These objectives are uniquely fulfilled by the foam curler and method for its manufacture in accordance with the present invention.

Preferably, commercial, peripherally sealed, extruded foam, sealing cord, normally used in building construction projects, can be used for the manufacture of the present foam curlers. This material, produced in continuous lengths with round or oval cross-sections, is relatively cost-effective and easy to work with.

For each of the curlers the exact amount of material necessary for its production is cut from the continuous length of sealing cord. The formative pliable core also is prepared in the required length, which is generally shorter than the length of the plastic body. Therefore, there is practically no waste. The production can be carried out speedily, since there are practically no substantial heating, melting or cooling processes involved. The quality of the foam curler surface can be easily selected by choosing a suitable circular sealing cord. According to the present invention, foam curlers can be constructed at little cost.

The resulting curlers have the advantages of being danger-free and comfortable to wear. In a preferred embodiment, the surface of the foam curler is structured in such a way that during the curling of a persons hair, air circulation between the curler and the wrapped-around hair is made possible.

Further advantages, characteristics and application possibilities of the present invention are described in the following detailed description taken in conjunction with the accompanying drawings.

DETAILED DESCRIPTION OF THE DRAWINGS

Figure 1:
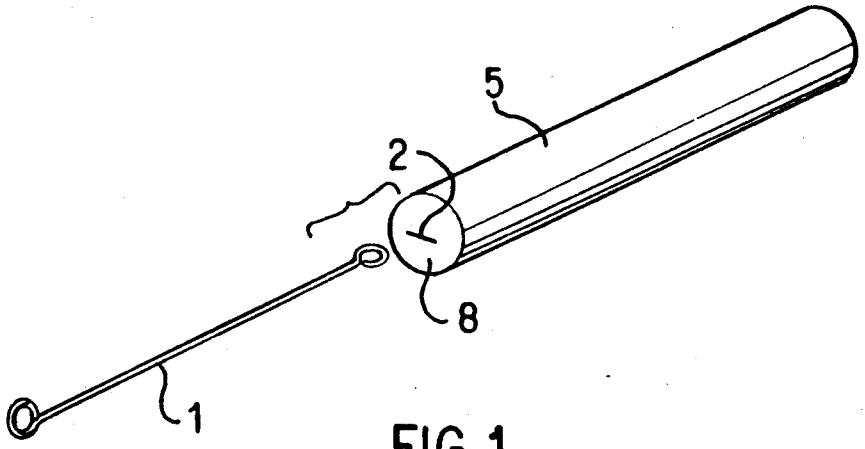
FIG. 1 is a perspective view of the main components of a foam curler according to the present invention.

In accordance with the present invention, FIG. 1 shows the two main components of a deformable foam curler. Such a curler is made up of a plastic body 5 and a formative pliable core 1. The plastic body 5 is cross-cut from a continuous length of sealing cord to produce a cylindrical body with two flat ends. The sealing cord profile can have a round or oval cross-section. Sealing cords used in the process of producing the present curlers are generally utilized in the building construction field for sealing wall joints, windows and/or doors. The sealing cords are, to a large extent, produced from extrusion-foamed polyethyles, polypropyles, or other synthetic materials and referred to hereinafter and in the appended claims as "construction industry sealing cord".

The formative pliable core 1 is produced from a material that can easily be bent and, after bending, remains in the bent state. Normally, single or clustered metal wires, formative pliable synthetic materials, or fiber-saturated materials are used as pliable core material. When the pliable core is constructed of metal wires or so that it has very thin ends, it is advantageous to bend each of the ends of the pliable core into a loop. Alternately, the rolling of the ends of the pliable core into mushroom shape is also practical. At any rate, the ends should be formed in such a way that a random contact of the ends of the formative pliable core with the scalp of someone using the curlers does not create an injury.

Figure 2A:
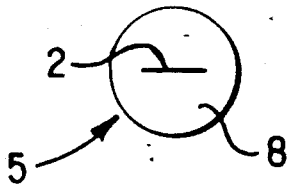
FIGS. 2A–2C are front end views of foam curlers in accordance with three different embodiments of the present invention.
Figure 2B:
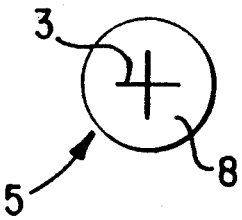
Figure 2C:
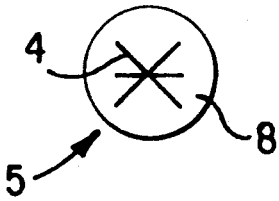

After cross-cutting the plastic body 5 from the construction industry sealing cord, a slit is cut through a cut end 8 into the plastic body 5. The slit can have any profile. Examples of slit profiles are shown in FIGS. 2A–2C. Depending on the shape of the punch tool used for producing the slit, the slit can, in its cross-section, have the shape of a line 2, cross 3 or star 4 as shown in FIGS. 2A, 2B and 2C, respectively. Other slit profiles (not shown) are possible. Depending on the structure of the synthetic material used for the plastic body 5, a hole (not shown) may be bored in the cut end 8 instead of punching a slit. The resulting opening in the plastic body 5 (slit or hole) must merely be surrounded by material from all sides except at the cut end.

During the slitting process, the plastic body 5 is, for example, held by a prism-shaped holding device (not shown) which grasps the plastic body along its sides. Any other holding device that avoids sideways shifting of the plastic body, can also be used.

After the slit or hole has been produced, the formative pliable core 1 is inserted into the plastic body 5.

In another form of construction, the slit is produced lengthwise in the side of the plastic body 5 instead of in the cut end 8, whereby the core 1 is inserted into the foam body 5 through the slit in the side of the plastic body 5.

It is advisable to close up the slit or hole by way of sealing or welding after the pliable core 1 has been inserted therethrough.

In yet another form of construction, the formative pliable core 1 can be pressed into or shot into the plastic body 5 through the cut end 8. It could be advantageous to heat the formative pliable core 1 prior to insertion into the plastic body 5 to assure a good connection with the plastic body 5.

In an additional form of construction, the formative pliable core 1 is heated to a temperature sufficient prior to insertion so that the heated core can melt its way into the plastic body 5.

Figure 3:
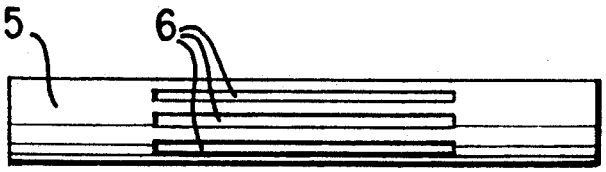
FIG. 3 is a side view of an embodiment of the present invention of a curler with a structured surface.
Figure 4:
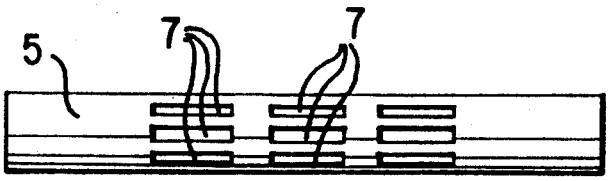
FIG. 4 is a side view of another embodiment of the present invention of a curler with a structured surface.

In any desired manufacturing step, the surface of the plastic body 5 can be structured. This structuring can be accomplished even when the plastic body 5 is still a part of the construction industry sealing cord. It would be preferable, however, to structure the plastic body 5 after it has been cross-cut from the construction industry sealing cord, and prior to or after insertion of the formative pliable core 1. The structuring process forms grooves 6, notches 7 or other indentations into the outer surface of the plastic body 5. Examples of structured foam curlers are shown in FIGS. 3 and 4. To create the respective indentations in the curler surface during structuring, foam material can be removed from the plastic body 5 by cutting. In another form of construction, the indentations are produced through heat treating the curler body 5 by pressing a heated form against the plastic body 5 so that the desired indentations, grooves 6 or notches 7 are melted into the surface of the plastic body 5.

During use of the deformable foam curlers of the present invention when moist hair is wound around the plastic body 5, air can circulate between the hair and the curler through the grooves 6 or notches 7 and contribute to the speedy drying of the hair. The grooves 6 and notches 7 can be extended along the entire length of the plastic body 5. It could, however, be useful to have the grooves 6 or notches 7 extend only over the middle of the plastic body 5 as shown in FIGS. 3 and 4.

It is contemplated and will be apparent to those skilled in the art from the preceding description and accompanying drawing illustrations, that modifications and/or changes may be made in the disclosed embodiment without departure from the invention. Accordingly, it is expressly intended that the foregoing description and accompanying drawings are illustrative only, not limiting, and that the true spirit and scope of the present invention will be determined by reference to the appended claims.

I claim:

1. A deformable foam curler comprising:

a plastic body defined by a cross-cut cylindrical section of an extrusion-foamed construction industry sealing cord, the plastic body having a water impervious cylindrical outer surface distinct from the opposite ends of said plastic body, said plastic body having open formation within said synthetic material and extending for at least a substantial portion of the length of said body; and a formative pliable core received within said open formation to be substantially concentric with said cylindrical surface and being of a length less than the length of said body.

2. A deformable foam curler as defined by claim 1, wherein the formative pliable core is shorter in length than the plastic body.

3. A curler as defined by claim 1, wherein the plastic body has indentations on its surface.

4. A curler as defined by claim 3, wherein the indentations are an arrangement of grooves cut through said impervious outer surface.

5. A curler as defined by claim 3, wherein the indentations are an arrangement of notches defined by inward deformation of said outer surface.

6. A curler as defined by claim 3, wherein the indentations are arranged over a partial surface area of the plastic body.

7. A deformable foam curler comprising:

a plastic body defined by a cross-cut cylindrical section of a construction industry sealing cord for sealing joints and openings in structures, such sealing cord being formed of extrusion-foamed synthetic material consisting of one of the group polyethylene and polypropylene and having an outer cylindrical surface throughout the length thereof, said plastic body having open formation within said synthetic material and extending for at least a substantial portion of the length of said body; and a formative pliable core received within said open formation to be substantially concentric with said cylindrical surface and being of a length less than the length of said body.

8. A curler as defined by claim 7, wherein said open formation is defined by at least one slit extending longitudinally of the body from one end thereof.

9. A curler as defined by claim 7, wherein said open formation is defined by crossed slits extending longitudinally of the body from one end thereof.

10. A curler as defined by claim 7, wherein said open formation is defined by a bore extending longitudinally of the body from one end thereof.

* * * * *